US007356979B2

(12) United States Patent
Pannekeet

(10) Patent No.: US 7,356,979 B2
(45) Date of Patent: Apr. 15, 2008

(54) METHOD AND APPARATUS FOR MANUFACTURING A BAG PACKAGE, AND BAG PACKAGE

(75) Inventor: Petrus Clemens Maria Pannekeet, Alkmaar (NL)

(73) Assignee: Jarsan Beheer B.V., Alkmaar (NL)

( * ) Notice: Subject to any disclaimer, the term of this patent is extended or adjusted under 35 U.S.C. 154(b) by 610 days.

(21) Appl. No.: 10/681,826

(22) Filed: Oct. 8, 2003

(65) Prior Publication Data

US 2004/0103621 A1 Jun. 3, 2004

(30) Foreign Application Priority Data

Oct. 9, 2002 (NL) ..... 1021612

(51) Int. Cl.
*B65B 9/00* (2006.01)

(52) U.S. Cl. ..... 53/451; 53/389.2; 53/550; 53/551; 53/554

(58) Field of Classification Search ..... 53/389.2, 53/451, 551–554, 410, 411; 383/117
See application file for complete search history.

(56) References Cited

U.S. PATENT DOCUMENTS

| | | | | |
|---|---|---|---|---|
| 2,146,308 | A | | 2/1939 | Maxfield |
| 2,154,521 | A | | 4/1939 | Maxfield |
| 3,207,300 | A | | 9/1965 | Farmer |
| 3,267,822 | A | | 8/1966 | Harrison |
| 4,091,595 | A | * | 5/1978 | Pelster et al. ..... 53/417 |
| 4,106,261 | A | | 8/1978 | Greenawalt |
| 4,795,268 | A | * | 1/1989 | Jorda ..... 383/40 |
| 5,226,735 | A | | 7/1993 | Beliveau |
| 5,823,683 | A | * | 10/1998 | Antonacci et al. ..... 383/107 |
| 5,912,197 | A | | 6/1999 | Madderom |
| 6,658,818 | B2 | * | 12/2003 | Kurth et al. ..... 53/426 |
| 6,761,012 | B2 | * | 7/2004 | Rusert et al. ..... 53/410 |

FOREIGN PATENT DOCUMENTS

| | | |
|---|---|---|
| EP | 0302460 A1 | 8/1988 |
| EP | 0405595 A1 | 6/1990 |
| EP | 1053939 A1 | 5/2000 |
| NL | 1007029 | 9/1997 |
| NL | 1021612 | 10/2002 |
| WO | WO 99/14121 | 3/1999 |

* cited by examiner

*Primary Examiner*—Thanh K. Truong
(74) *Attorney, Agent, or Firm*—Swanson & Bratschun, L.L.C.

(57) ABSTRACT

A method for manufacturing bag packages, in which netting material of bags to be formed is connected to at least two foil strips which are each provided with a printing repeating in the longitudinal direction of the strip, with the foil strips being supplied in a coupled manner from one stock. The foil strips are preferably obtained from a foil stock comprising a single strip of foil with at least two repeating printing patterns with concurrent repeat which are applied next to each other, with the single strip being divided into sub-strips each bearing a repeating printing pattern.

6 Claims, 4 Drawing Sheets

METHOD AND APPARATUS FOR MANUFACTURING A BAG PACKAGE, AND BAG PACKAGE

This application claims benefit of Netherlands Application Serial Number NL 1021612 entitled, "Method and Apparatus for Manufacturing a Bag Package, and Bag Package", filed on Oct. 9, 2002, which application is incorporated herein in its entirety by reference.

The invention relates to a method for manufacturing a bag package from tube-shaped or strip-shaped netting material, wherein the netting material of the bag to be formed is connected with at least two foil strips which are each provided with a longitudinally repeating printing.

Such a method for manufacturing a bag package from tube-shaped or strip-shaped material is generally known and is used for manufacturing bag packages for fruit, vegetables, potatoes, onions, nuts, etc.

In packaging, the netting material is used to form a tube which is each time provided with a transverse weld at a bottom side, resulting in a bag. The bag is filled with the products to be packaged and is closed by means of a second transverse weld, after which the bag is ready as a package and can be separated. The tube can be supplied from a stock, such as a roll. However, the tube can also be assembled, during the manufacture of the bag package, from one or more strips at least partly. overlapping at their longitudinal edges, including at least one strip with material, with overlapping parts of the strips being connected by means of welds running in the longitudinal direction of the strips.

The netting material ensures that the bag package is sufficiently open for aerating the packaged products, but still maintains sufficient strength to be able to carry the weight of the products.

However, by nature, the netting material is not well suitable for applying an easily readable printing to it. Therefore it has previously been proposed to connect the netting material to at least two foil strips which are each provided with a longitudinally repeating printing. The foil strips extend, for instance, in the longitudinal direction of the bag package between the transverse welds, over a front and rear side of the bag. By means of such a printed foil, for instance, a front side of the bag package can be provided with an attractive-looking printing with brand name, while the strip on the rear side can be provided with product information.

EP 1 053 939 describes a method of the type described in the opening paragraph, in which a tube foil is provided with a strip of printed foil on both sides when the bag is filled, while NL 1007029 in applicant's name proposes to provide a web of material with a strip of foil, which web of netting material, after being formed into a sleeve, is provided with a second strip of foil over the overlap area of the longitudinal edges of the strip.

In this, the foil strips are each obtained from a stock, for instance a first roll of foil with a repeating printing pattern defining the front side of the bag package to be filled and a second roll of printed foil arranged separately therefrom forming the rear side of the bag package to be formed.

A problem that occurs in the known method is the matching of the repeat of the strip on the front side to the repeat of the strip on the rear side. The fact is that, when, as is usual in the manufacture of netting bag packages, some thousands of netting bag packages are manufactured in succession from the stock of netting and strip material, the repeat of the first strip and the repeat of the second strip are not concurrent. In practice, this problem has been solved in NL 1007029 by choosing the repeat of the printing strip for the front side to be equal to the length of the bag package between the transverse welds and by stepwise control of the throughput by means of a marking which co-repeats in the printing pattern. In this, the second foil strip, forming the rear side, is carried along with the netting material from a free running roll. By choosing the length of the repeat of the printing of the second foil strip to be more than two times smaller, it can be ensured that the printing pattern is at least once reproduced in its entirety on the rear side of the bag package. Although such a trailing roll can provide for a rapid and inexpensive method, a package manufactured in this manner looks less neat, at least on the rear side.

To remove this objection, it has already been proposed to connect, in advance, under controlled conditions, two strips of foil material in flat condition to flat strips of netting material, so that a concurrent repeat is obtained, and to roll up this assembled strip and to then use it as stock. However, a disadvantage of this proposal is that the stock rolls can contain relatively little strip length due to the welds present thereon and therefore take up much storage space.

Of course, it is possible to provide the second printing strip with a co repeating marking as well and to guarantee the concurrence of the repeats of the strips by means of an extension of the control system. However, this is too costly in practice and can further give rise to loss of productivity and to failure.

The invention has as its object a method of the type referred to in the opening paragraph, by means of which two foil strips which are each provided with a longitudinally repeating printing with concurrent repeat can be processed into bag packages in a simple and inexpensive manner. For this purpose, the method according to the invention is characterized in that the foil strips are supplied in a coupled manner from one stock.

By obtaining the foil strips in a coupled manner from one stock, the concurrence of the repeats can be guaranteed.

The foil strips can, for instance, be supplied from stock in a coupled manner when this stock is designed as at least two separate rolls of foil taken up from mechanically coupled spindles or carried on a central spindle. In an elegant manner, the two strips are supplied in a coupled manner from one stock in that the foil stock comprises a single foil strip with at least two repeating printing patterns with concurrent repeat applied next to each other, which strip is divided across the width into sub-strips each bearing a printing pattern. Here, the foil stock can, for instance, be a strip wound in a zigzag manner, but is preferably a strip foil wound into a roll, for instance a roll of foil on which, in the width direction of the strip, printing patterns corresponding with the front side and with the rear side of the package are applied next to each other in a repeat corresponding with the length of a bag.

In an advantageous manner, such a roll is designed as a trailing roll, with the stock roll being unwound due to the foil webs moving along with the netting material after coupling.

In this manner, in the packaging of products, the printing of the package can easily be changed: only one stock roll with printed foil needs to be changed. It will be clear that this considerably simplifies the stock management of the materials needed for assembling different packages and reduces the chance of mistakes in choosing the foil webs for packages of different clients or products.

Preferably, the sub-strips are connected in flat condition to a flat strip of netting material. By applying at least one of the sub-strips on the netting material in an overlapping manner across only a part of its width, netting material can be saved. Then, the total width of the strips of netting material can be smaller than the circumference of the tube formed with the netting material and the strips.

In an advantageous manner, a tube can be formed, for instance with the netting material, by spacing apart two parallel webs of netting material and applying, in an overlapping manner, both longitudinal edges of a first sub-strip of foil material on the longitudinal edges facing each other of the strips of netting material by means of longitudinal welds, and applying a further sub-strip on a different longitudinal edge of one of the webs of netting material, in an overlapping manner only near one longitudinal edge, and attaching it by means of longitudinal welds. The thus assembled strip can be formed into a tube by moving the free longitudinal edges towards each other and attaching them with the strip of foil material as a lap with a minor overlap by means of longitudinal welds.

Optionally, the webs of netting material can also be supplied from one stock, for instance as a strip of netting material which is supplied from a stock roll and which is separated by means of a separating device, for instance a knife or an incandescent filament. Also, prior to separation, the strip of the netting stock can be provided with weakenings or tearing lines in order to facilitate separation.

It is noted that it is, of course, also possible to provide one broad strip of material with a first printed strip applied across its entire width on the netting material and a second strip only applied across a part of its width on a longitudinal edge of the strip of netting material.

It is further possible to connect one sub-strip to the netting material before a sleeve is formed therewith and to connect another sub-strip to the netting material after a tube has been formed therewith. It is also possible to connect sub-strips to the netting material while this is being formed into a tube. It is also possible to connect all sub-strips to the netting material after a tube has been formed herewith.

The invention also relates to an apparatus for carrying out the method according to the invention and to a strip of foil material for use in the method and the apparatus according to the invention.

Further advantageous embodiments of the invention are described in the sub claims.

It is noted that, in this context, netting material is understood to mean a coarse-meshed structure of connections, preferably made up of threads running in the longitudinal and transversal directions, preferably flat cloth threads, which are connected at the places where they cross each other. Preferably, the netting material is manufactured from a synthetic. The threads can then be fused at the crossings. However, here, netting material is also understood to mean a woven netting structure, from synthetic material or not, as well as a netting structure formed by providing foil with perforations forming the meshes of the netting.

In addition, it is noted that, in this context, foil material is understood to mean a substantially closed, sheet-shaped material. The sheet-shaped material can comprise multiple layers. Preferably, the foil material is manufactured at least partly from synthetic material.

Further, in this context, welding is understood to mean connecting by means of fusing and/or bonding.

It is also noted that, in this context, a concurrent repeat is understood to mean a situation in which the repeating patterns have a fixed phase difference in relation to one another; therefore, repeating patterns having a fixed phase difference in relation to one another, repeating patterns having a fixed shift in relation to one another as well as repeating patterns not having a shift are included.

The invention will be explained in more detail with reference to an exemplary embodiment shown in a drawing, in which.

It is noted that the Figures are only diagrammatic representations of an exemplary embodiment of the invention which is solely given by way of non-limiting exemplary embodiment. In the Figures, the same and corresponding parts are designated by the same reference numerals.

Figure 1:
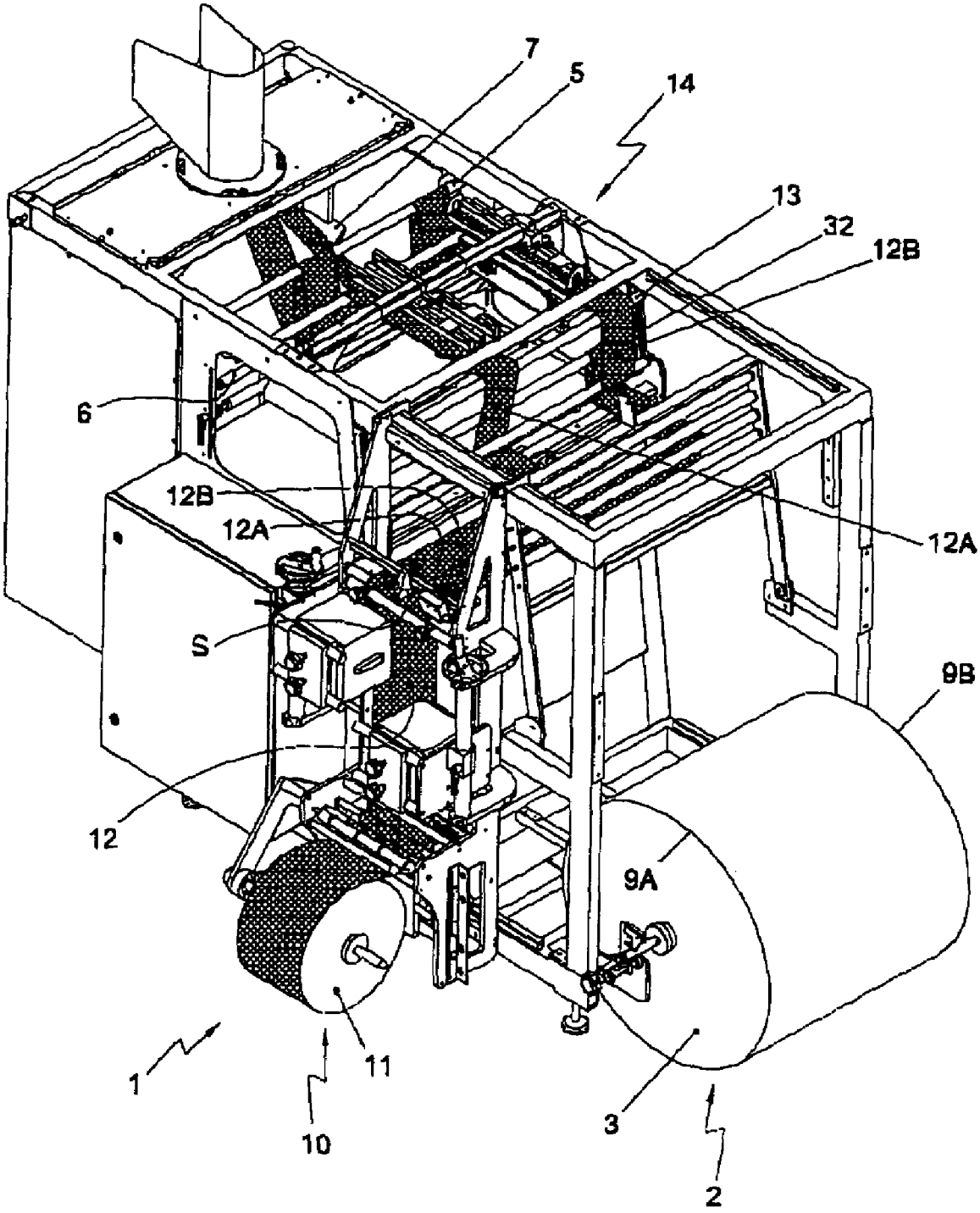
FIG. 1 shows a diagrammatic perspective view of an apparatus for carrying out the method according to the invention.
Figure 2:
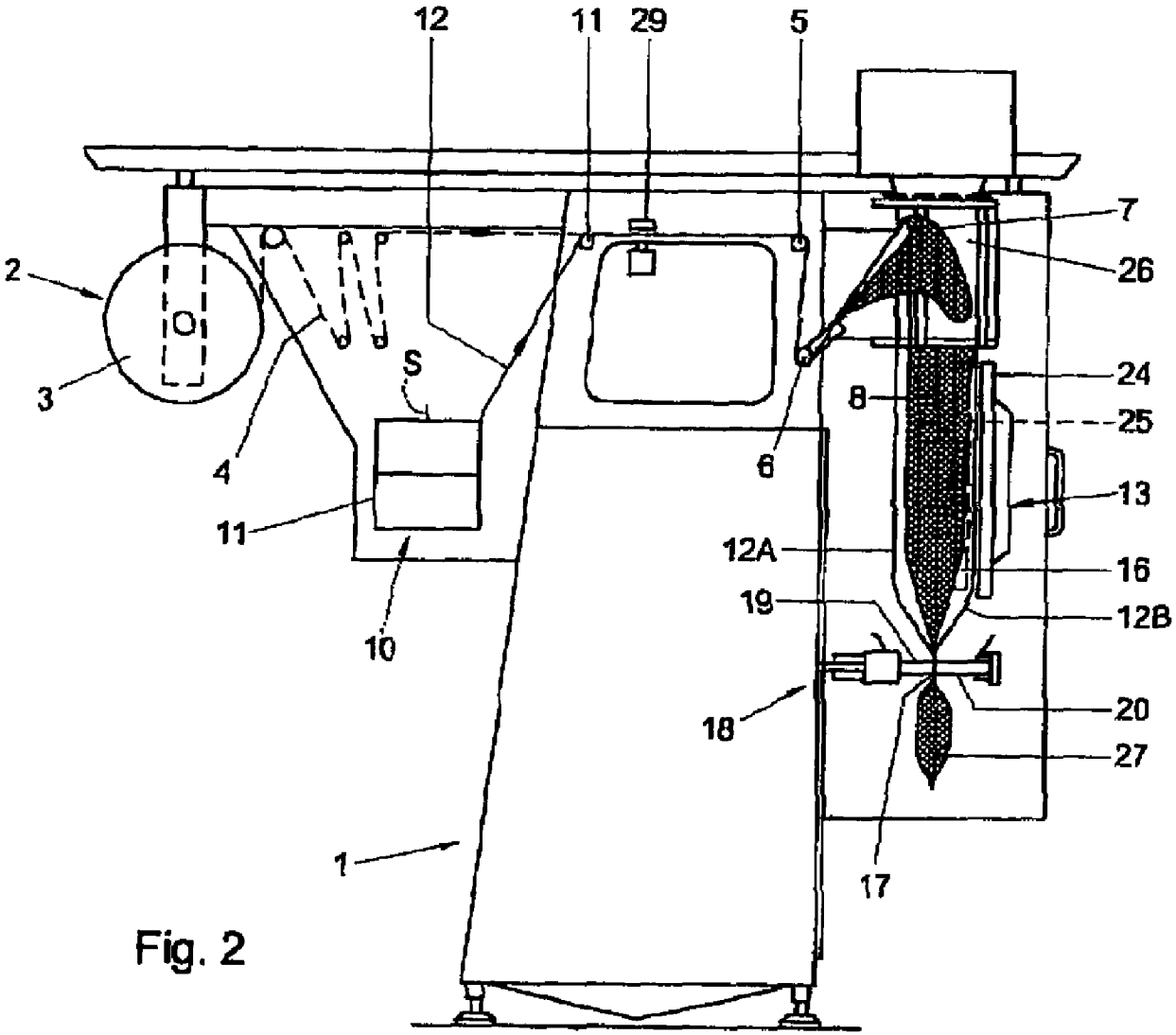
FIG. 2 shows a diagrammatic side elevational view of an apparatus for carrying out the method according to the invention.

The apparatus shown in FIGS. 1 and 2 comprises a machine frame, designated in its entirety by 1, on which a station 2 is present with a rotatably suspended roll 3 with web-shaped netting material 4. FIG. 1 does not show the web of the netting material for reasons of clarity. Further, for reasons of contrast, FIG. 1 shows the foil material as hatched, while the other Figures shows the netting material as hatched. It is noted that, for reasons of clarity, some parts of the machine frame are only shown in one of the two Figures.

Figure 3:
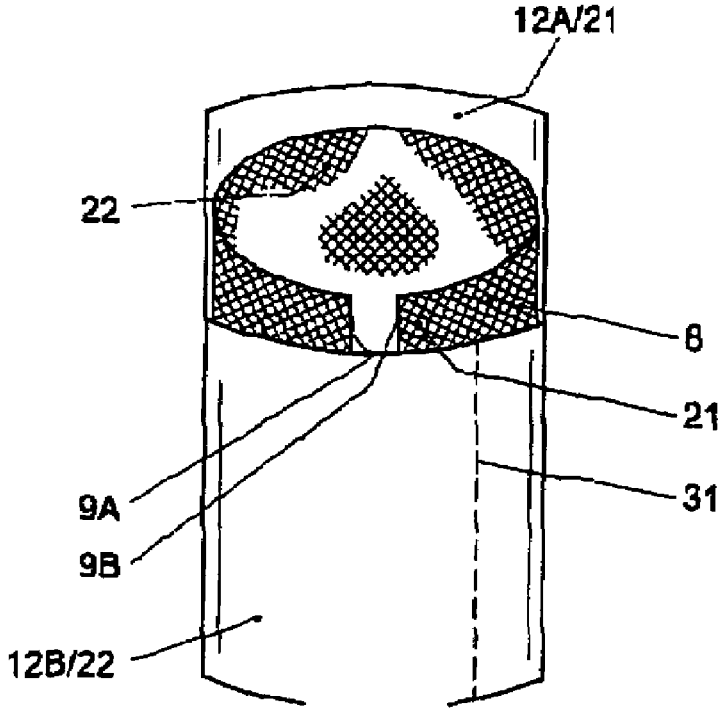
FIG. 3 shows a sleeve formed with strips of netting material and foil material.
Figure 4:
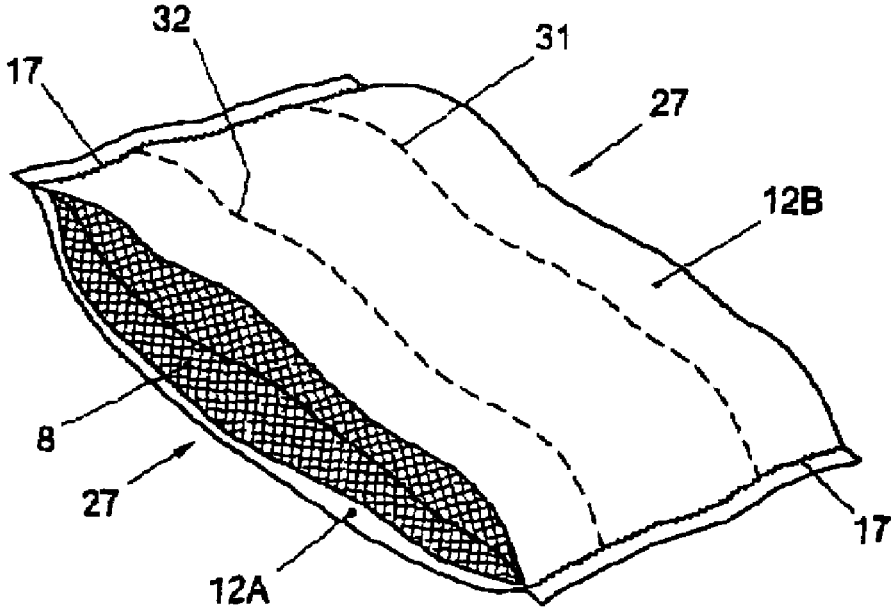
FIG. 4 shows a diagrammatic perspective view of a package according to the invention.

Via a number of intermediate rolls, the web of netting material 4 is supplied in substantially flat condition and ultimately fed over the rolls 5 and 6 to a so-called forming shoulder 7. At the location of the forming shoulder 7, with the netting material 4 and the foil material to be discussed hereinafter, a sleeve 8 is formed with overlapping longitudinal edges 9*a*, 30, as shown in FIG. 3.

Figure 5:
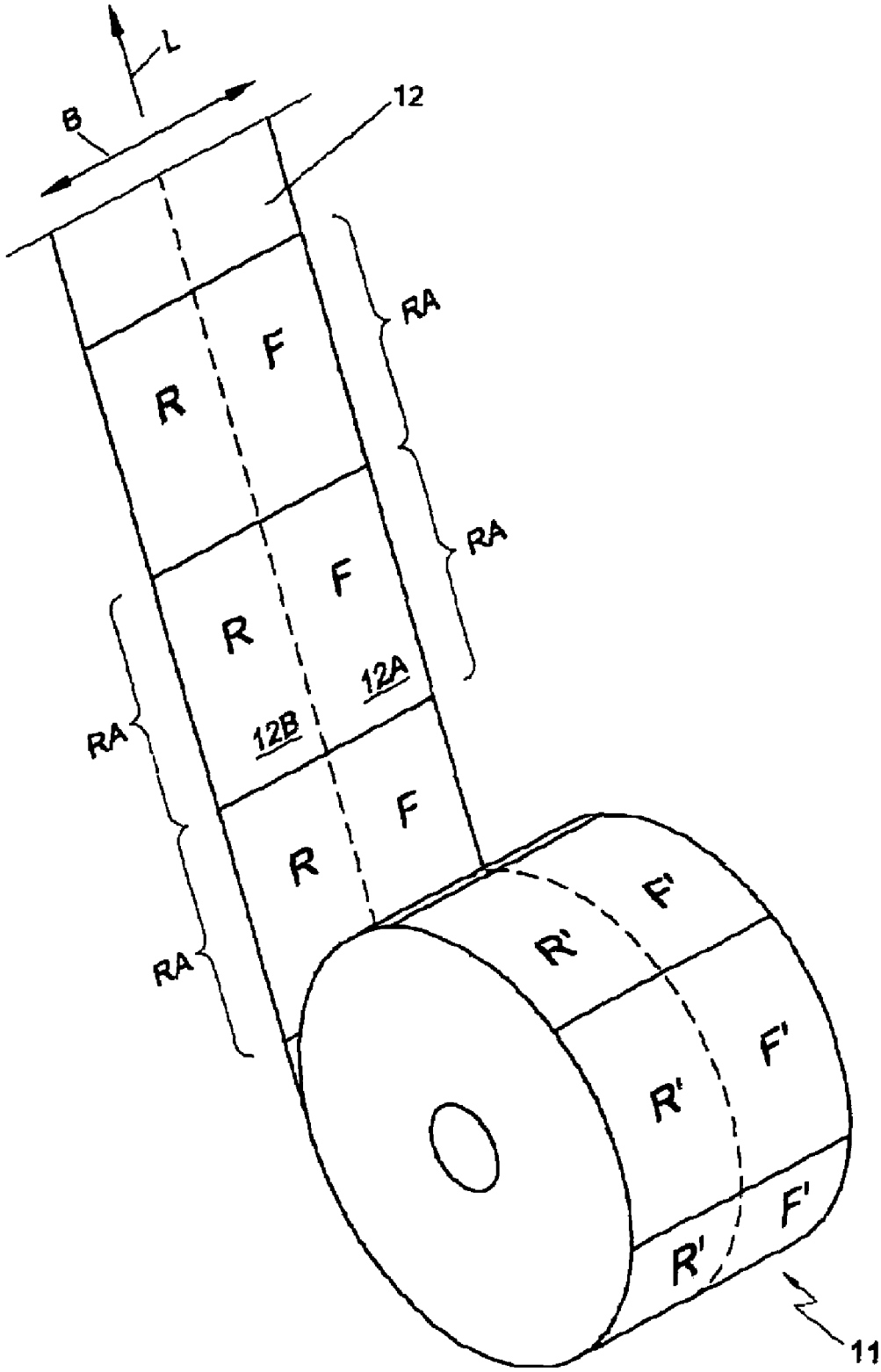
FIG. 5 shows a diagrammatic perspective view of a roll of foil material for use in the apparatus or the method according to the invention.

Furthermore, on the frame 1, a station 10 is provided, on which a single strip of foil 12 wound into a roll 11 is provided as foil stock. The strip of foil is shown hatched in FIG. 1. The single strip 12 is provided with two printing patterns R, F repeating in the longitudinal direction l of the strip and provided next to each other in the width direction b of the strip, which have the same repeating length Ra. The repeats of the printing patterns are concurrent, as is shown in FIG. 5. In the Figure, the rear sides corresponding with the printing patterns are designated by R', F'. The single strip of foil 12 is supplied in substantially flat condition via a number of intermediate rolls to a cutting device S by means of which the single strip 12 is divided into sub-strips 12*a*, 12*b* each bearing a repeating printing pattern. Via a number a number of intermediate rolls, the sub-strips 12*a*, 12*b* are each joined together in substantially flat condition to the netting material 4 near roll 13. The foil strips 12*a*, 12*b* are supplied in coupled condition, namely as one strip, from one stock, namely the roll 11.

In the embodiment shown here, the stock roll 11 is unwound as the foil webs 12*a*, 12*b* move along with the netting material 4, after they have been attached to the netting material 4, as will be elucidated hereinafter. One sub-strip 12*a* is placed on the flat strip with material in an overlapping manner across its entire width, preferably near the middle of the strip with material. The other sub-strip 12*b* is placed near the longitudinal edge 9*b* of the flat strip of netting material in an overlapping manner across only a part of its width. Via rolls 5 and 6, the sub-strips of foil material

12*a*, 12*b*, together with the strip of netting material, are fed to the forming shoulder 7. Over this forming shoulder, a sleeve 8 is formed with the strips of foil material 12*a*, 12*b* and the strip of netting material 4, with the sub-strip 12*b* forming a lap which overlaps the longitudinal edge 9*a* of the netting material. After passing the roll 13, the sub-strips 12*a*, 12*b* of foil material and the netting material 4 are guided along a welding station 14 where, by means of local welding, the strips are attached to one another. In this, the sub-strip 12*a* is connected, near its longitudinal edges, to the netting material 4 by means of two longitudinal welds, while the sub-strip 12*b* is connected to the netting material by means of one longitudinal weld 31. This prevents the sub-strips of foil material 12*a*, 12*b* from being shifted at the location of the forming shoulder in relation to the netting material. By forming a loop by means of additional intermediate rolls 32, the difference in path length which the one sub-strip travels in relation to the other sub-strip to the netting material can be set at a natural multiple of the repeat length Ra, so that the sub-strips with printing patterns can be applied on the netting material in concurrent repeat. Of course, the patterns can also be included in the stock with a predetermined shift, so that additional intermediate rolls can be avoided.

Optionally, the web of netting material 4 from the stock roll 3 can be divided into sub-strips in an analogous manner. However, when supplying a netting material 4 which is divided into sub-strips from a central roll 3, intermediate rolls for path length compensation are not necessary. After all, the netting material does not show any repeat.

By means of a second welding station 23, the overlapping part of the strip of netting material 9*a* and the second sub-strip 12*b* are welded to each other by means of a longitudinal weld 32. For this purpose, the welding station 23 has a jaw 24 placed outside the sleeve 8, as well as a format pipe 25 placed inside the sleeve. Under the influence of the heat and pressure supplied by the jaw 24, the weld 32 running in the longitudinal direction is obtained, by means of which the sleeve 8 is closed into a ring.

The netting material 8 and the sub-strips 12*a*, 12*b* are then formed into a bag by means of a weld 17 running in the transverse direction. For this purpose, a welding station 18 is provided, which has two jaws 19, 20 applying heat and pressure on the package consisting of the front wall 21 formed by the sub-strip 12*a*, the rear wall 22 formed by the sub-strip 12*b* and the netting material 4 of the sleeve 8 extending between them. FIG. 3 shows that the longitudinal edges 9*a*, 9*b* of the strip of netting material 4 do not overlap each other. Because the second sub-strip 12*b* forms a lap, the width of the strip of netting material 4 can be chosen to be smaller than the circumference of the sleeve to be formed.

Via filling station 26, a predetermined amount of products is introduced into the sleeve 8 via the format pipe 25, after which the sleeve is moved downwards at the location of the weld 17 by means of the jaws 19, 20. Then, above the introduced products, a second transverse weld 17 is provided by means of jaws 19, 20, so that the netting package is formed into a closed bag 17 which can then be separated. The roll 3 of netting material 4 and the roll 11 of foil material 12 can be designed as trailing rolls designed without their own drive, with the supply of the netting material and the foil material from the stock being effected by each time intermittently moving the sleeve downwards at the location of the lower weld 17, over the length of the package, corresponding with the repeat length Ra. Optionally, the throughput of the material can be stepwise controlled by means of a sensor system 29, using a co-repeating marking in the printing pattern of one of the sub-strips.

It is noted that the invention is not limited to this preferred embodiment shown here and that many variants are possible.

For instance, instead of a cutting device, a separating device can be provided by means of which the single strip is separated into sub-strips, for instance when the single strip is provided with a perforation or tearing line. Further, the foil strips can be supplied in a coupled manner from one stock in that separate rolls of foil material are carried on a central spindle or are carried on mechanically coupled spindles. Further, the foil strips can be added to the netting material after a tube has been formed, for instance when the netting material is supplied from a stock as a tube. Of course, it is also possible to supply the foil strips in a coupled manner from one stock and to supply a first number of sub-strips to the netting material before the formation of the sleeve and another number of sub-strips after or during the formation into a sleeve. Also, the sleeve can be moved continuously and the movement of the sleeve can, for instance, also be effected by means of friction belts instead of a movable jaw.

Further, the foil strips can be provided with a layer of adhesive to save on, for instance, welding stations.

Such variants will be clear to a person skilled in the art and are deemed to fall within the scope of the invention as set forth in the following claims.

The invention claimed is:

1. A method for manufacturing bag packages, wherein netting material of bags to be formed is connected to at least two foil strips which are each provided with a printing pattern repeating in a longitudinal direction of the foil strip, characterized in that the foil strips are supplied in a coupled manner from one foil stock.

2. The method according to claim 1, wherein the foil strips are obtained from the foil stock comprising a single strip of foil with at least two repeating printing patterns with concurrent repeats provided next to one another, wherein the single strip is divided into sub-strips each bearing the repeating printing pattern.

3. The method according to claim 2, wherein the single strip is obtained from a stock roll.

4. The method according to claim 3, wherein the stock roll is unwound by foil webs moving along with the netting material.

5. The method according to claim 2, wherein at least one of the sub-strips is connected in flat condition to a flat strip of the netting material.

6. The method according to claim 2, wherein at least one of the sub-strips is connected to a flat strip of the netting material in an overlapping manner across only a part of its width.

* * * * *